United States Patent [19]

Roncan

[11] 3,941,086

[45] Mar. 2, 1976

[54] FLUID DOCTOR BLADE

[75] Inventor: Riccardo Roncan, Genoa, Italy

[73] Assignee: Italsider S.p.A., Genoa, Italy

[22] Filed: Oct. 23, 1974

[21] Appl. No.: 517,132

Related U.S. Application Data

[63] Continuation of Ser. No. 386,813, Aug. 8, 1973, abandoned, which is a continuation-in-part of Ser. No. 144,186, May 17, 1971, Pat. No. 3,753,418.

[52] U.S. Cl. ..... 118/63

[51] Int. Cl.[2] ..... B05C 11/06

[58] Field of Search ..... 118/63; 117/102 L, 102 M; 34/155; 15/1 NQ; 427/348, 349

[56] References Cited

UNITED STATES PATENTS

| | | | |
|---|---|---|---|
| 3,314,163 | 4/1967 | Kohler | 118/63 X |
| 3,499,418 | 3/1970 | Mayhew | 118/63 X |
| 3,687,103 | 8/1972 | La Camera et al. | 118/63 |

*Primary Examiner*—Morris Kaplan

*Attorney, Agent, or Firm*—Nolte and Nolte

[57] ABSTRACT

Opposed fluid doctor blades include each a slotted elongated nozzle including adjustable lip elements adaptable to vary the configuration of the fluid blade. Blade elements disposed within the nozzle are adjustable along the elongated extent of the slot whereby to adjust the effective length thereof.

3 Claims, 7 Drawing Figures

Fig. 1.
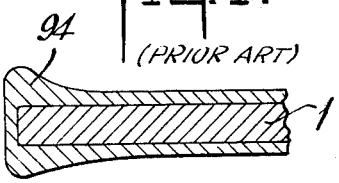
Fig. 2.
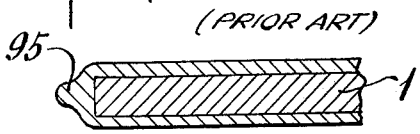
Fig. 4.
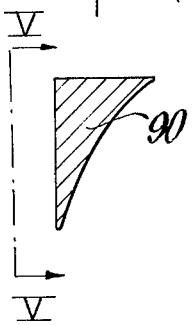
Fig. 5.
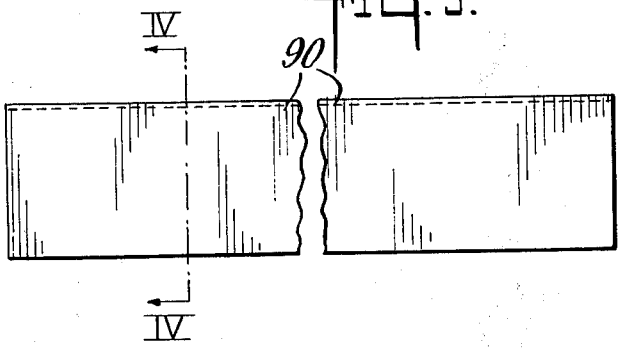
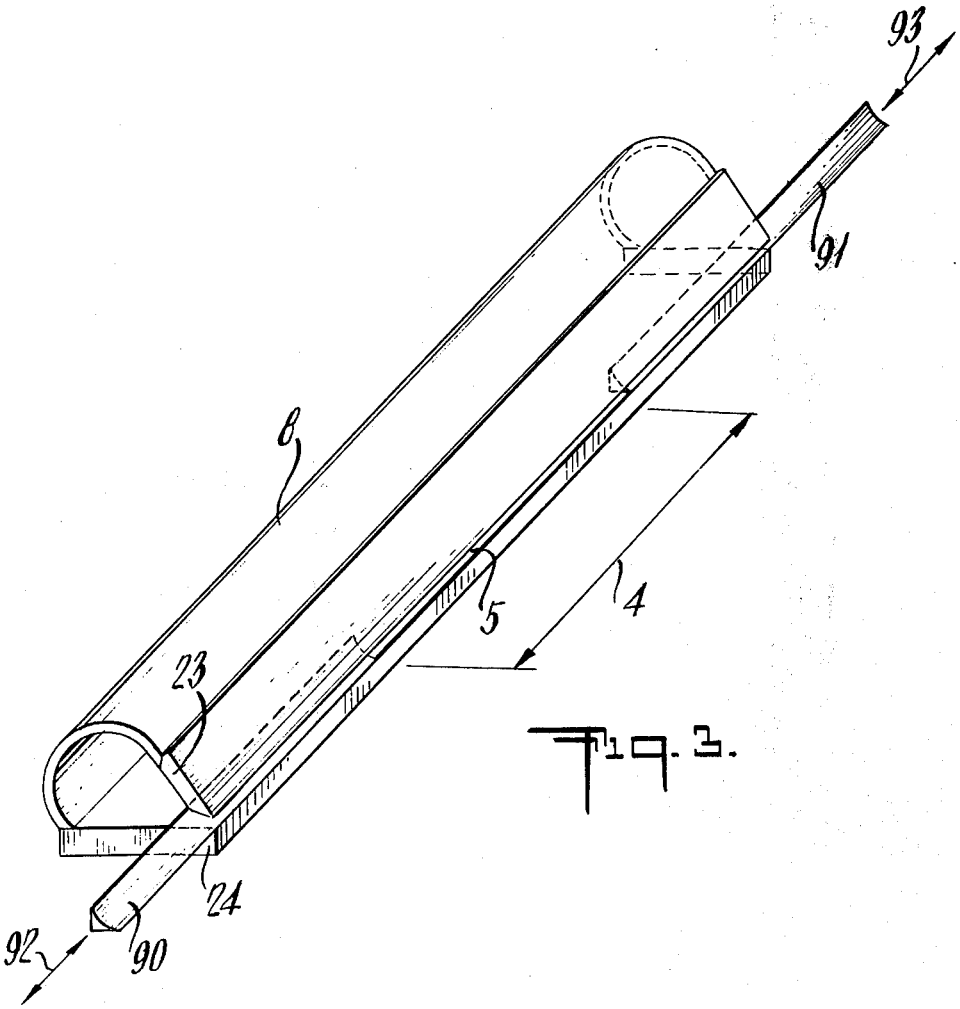
Fig. 3.

FLUID DOCTOR BLADE

This is a continuation, of application Ser. No. 386,813 filed Aug. 8, 1973, now abandoned, which is a continuation-in-part of application Ser. No. 144,186, filed May 17, 1971, now U.S. Pat. No. 3,753,418.

This invention relates to an improved fluid doctor blade.

More particularly, this invention relates to the aforesaid device for use in the variable linear control of the longitudinal opening of a linear manifold.

The invention disclosed in the parent application heretofore cited has for its object an improved device for use in the continuous control of the zinc coating on a steel sheet. The device, as described, is of the type comprising a pair of horizontal manifolds arranged, just above the surface of the molten zinc, on both sides of the coated metal strip as the latter comes vertically out of the zinc bath. Each of the manifolds is provided with an elongated nozzle of the slot-like variety formed by an upper and lower lip as described in such parent application. Each of the aforesaid devices is positioned to project a fluid blade against the surface of the steel strip in order to control the thickness of the zinc coating on the steel strip.

In accordance with the description of the parent application, one of the aforesaid lips is elastically strainable in order to provide, if desired, a variation in the longitudinal outlet port of the slot-like nozzle. This latter function may be accomplished along the entire length of the linear port or just a section thereof. The device, in operation, actually allows a good distribution of the zinc layer on the metal strip but there is one disadvantage. The device does not completely eliminate either the formation of a zinc overthickness on the edges of the coated strip or the formation of clots outside the edge of the coated strip.

It is therefore an object of this invention to provide means for use on a longitudinal manifold in order to control the linear port thereof, resulting in the elimination of the aforesaid disadvantages of the art.

Other objects and many of the attendant advantages of this invention will become apparent to one skilled in the art from a reading of the following detailed specification taken with the accompanying drawings, wherein:

FIG. 1 is a cross-sectional view of a coated product of the prior art exhibiting the thickness encountered on the edges thereof when an ordinary fluid doctor blade is utilized during processing;

FIG. 2 is a cross-sectional view of another coated product of the prior art exhibiting a second type of imperfection encountered when ordinary means are used to process the product;

FIG. 3 is a perspective view of a linear manifold having a longitudinal port provided with means for variable control of the length of such port;

FIG. 4 is a top plan view of the control means of FIG. 3 taken on line IV—IV of FIG. 5;

FIG. 5 is a cross sectional view of such means taken on line V—V of FIG. 4;

Figure 6:
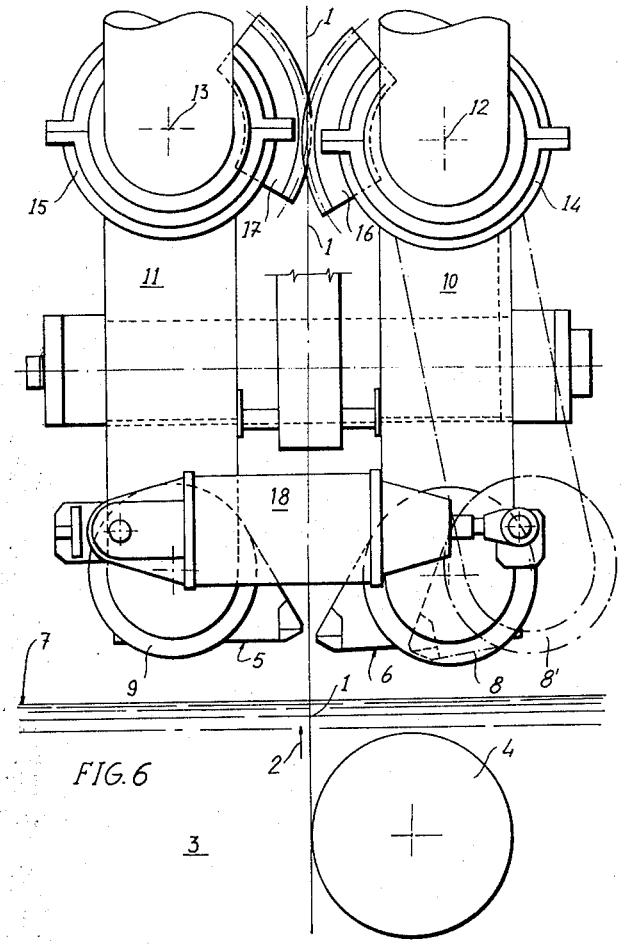
FIG. 6 is a side view of a fluid blade arrangement according to this invention.

The device of the subject invention is for use in the continuous control of the zinc coating on a metal sheet in the form of a strip coming out of a molten zinc bath at controlled temperature. The device is adapted for use with a pair of horizontal monifolds arranged above the bath surface on both sides of said metal strip, the manifolds each being provided with a slot-elongated nozzle. The port of the nozzle is formed by two lips positioned relative to each other for use in projecting a fluid blade against the surface of the coated strip. The device of this invention comprises two side linear shutters each of which is longitudinally slidable inside said nozzle for separable linear engagement of a section of the linear port. This allows a variation in the length of the fluid blade continuously during the plant operation.

The device of the subject invention is further characterized in that the shutters consist of elongated or linear bars having a cross section substantially equivalent to the inner cross section or inner profile of the port formed by the upper and lower lips. In this manner the shutters are able to slide against the inner surfaces of the lips which define the slot-like nozzle for effective and efficient use in the formation of the desired width of the fluid doctor blade. The device of this invention is further characterized in that the aforesaid shutters may be actuated by manual or automatic means of the conventional variety to to ensure that the nozzle width defined by their individual positions is substantially equal to the width of said metal strip. The present device is further characterized in that the actuating means may be maintained in position to keep the width of the slot-like nozzle in a centered position relative to the metal strip.

With particular reference to the drawings, as seen in FIG. 3, the manifold 8 has an elongated form and is arranged horizontally. The pressure fluid is fed to one or both ends of the manifold through conduits (not shown). The manifold 8 is suitably supported so as to be in position to vary both its distance from the coated metal strip and its inclination with respect to a horizontal axis thereof as heretofore described in the cited parent application.

The manifold 8 is provided with a slot-like nozzle extending for the whole length of said manifold and directed towards the metal strip just coated with the layer of molten metal. The nozzle consists of two lips of which the lower one 24 is elastically strainable and the upper one 23 is stiff.

In accordance with the subject invention, the useful width of the slot-like nozzle is defined each time through two shutters 90 and 91 in spaced relationship one to the other. Also, the cross section of the device substantially fills the cross section or inner profile of the slot-like nozzle and is slidably positioned inside said nozzle against said two linear lips 23 and 24 by any conventional push or pull mechanism. Thus, by moving the two shutters 90 and 91 in linear fashion and in the direction of arrows 92 and 93, the width may be varied as desired.

As shown in FIG. 4, the shutters 90, 91 are made of metal but they may be made of any material which is substantially rigid or stiff so that they will slide along the inner profile of the nozzle lips.

Thus, according to this invention, it is possible to vary the useful width of the slot-like nozzle and to maintain it substantially equal to the width of the metal strip which is to be coated with a zinc layer. Therefore, it is possible to maintain the width of the air blade against the surface of said metal strip substantially equal to the width of said strip. This allows the edges of strip 1 to be substantially uniform without encountering the disadvantage shown in FIGS. 1 and 2. The latter are usually present on the edges of the strips obtained when the air blade has not the same width as the metal strip.

It is to be appreciated that there are variations in the width of the strips to be coated, such variaitons due to the usual factory limits of the metal strip and the possible side movements of said strip under treatment. However, these changes are also accompanied by a corresponding and timely displacement or change of shutters 90 and 91. Thus the width of the air blade at all times substantially equals the width of the metal strip and the coated strip and the air blade are always substantially centered with respect to each other. The displacements of shutters 90 and 91 with respect to the metal strip may be obtained in a known way manually or automatically through guide rollers, photocells and the like.

The differences between the position of the end of shutters 90, 91 and the outer edge of the strip may vary in some cases from 10 to 30 mm., according to the line speed and the coating weight desired.

Figure 7:
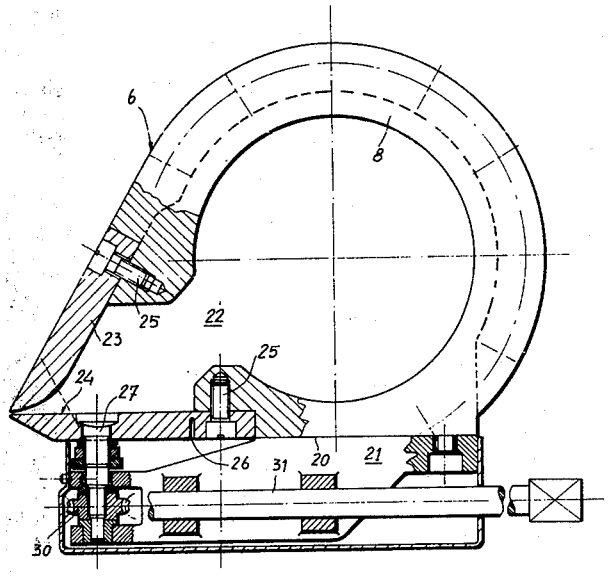
FIG. 7 is a part cross sectional, part elevational view of a detail of the apparatus of FIG. 6.

FIGS. 6 and 7 of the drawings are those of the grandparent of the present application, i.e., of application Ser. No. 144,186 filed May 17, 1971 and issued as U.S. Pat. No. 3,753,418 on Aug. 21, 1973. Like parts of the apparatus in FIGS. 6 and 7 are identified by the same reference numerals as utilized in FIGS. 1 through 5, although the shutter or strip elements are not shown in FIGS. 6 and 7. Referring to FIGS. 6 and 7, the metal strip 1 is stretched between two guide rollers, which are not shown, and is drawn in the direction of arrow 2 from a molten zinc bath 3 which is maintained at a suitable temperature by any convenient means. A stabilizing roller 4 for positioning the plane of the metal strip, primarily with respect to the nozzles 5 and 6 generating the fluid blades is arranged just above surface 7 of the bath 3 at a distance which should be between about 150 and 500 mm. The minimum values of such a gap are easily attainable by the structure illustrated whereas in the prior art devices such maintenance of minimum values has not been facilitated.

The nozzles 5 and 6 are fed by headers 8 and 9 respectively which consist of two preferably circular conduits, the diameters of which are large in comparison to the thickness of the fluid blades. These headers are fed by only two conduits 10 and 11 which are pivotted about horizontal and transverse axes 12 and 13 by means of suitable sealing joints 14 and 15 which are, of course, rotatable. The two joints are provided with two toothed sections 16 and 17 engaging each other so that turning of the conduit portion 10 is always accompanied by a contrary and equal turning of conduit 11 and vice-versa. The turning of conduits 10 and 11, which obviously accompanies the relative movement of nozzles 5 and 6 towards or away from each other and of course the metal strip 1 is effected by a pair of double acting jacks 18 arranged at the two ends of the headers 8 and 9 or directly connected to the outer surfaces of conduits 10 and 11 which also serve to support the headers 8 and 9. Shown in chain line 8′ is a laterally tilted position of the header 8. It is to be appreciated that besides shifting the nozzles 5 and 6 away from the metal strip 1 and into an inoperative position, the jack 18 also facilitates the variation of the distance of nozzles 5 and 6 from the metal strip and, of course, the variation of the angle between the fluid blades and said strip.

As will be apparent from a consideration of FIG. 6, the two fluid blades are arranged to be slightly staggered in their vertical position, i.e., the inner nozzle 5 is at a slightly higher position than is the outer nozzle 6. It is to be understood that by "inner nozzle" one means the nozzle which projects its fluid blade onto that face of the metal strip 1 which is not in contact with the adjusting roller 4.

While the inner nozzle is, in its lowest position, substantially perpendicular to the metal strip 1, the outer nozzle 6 is inclined towards the bottom by about 10°. This difference in inclination between the two nozzles clearly remains when both nozzles are rotated outwards for adjusting their distance from the metal strip 1 since, of course, that degree of rotation of the headers is similar. In FIG. 7 only a single nozzle 6 is illustrated, since of course the nozzles are basically similar, and the nozzle comprises a cylindrical header 8 which at the outer and lower part has the flattened surface 20 substantially horizontal which is suitable to provide support for brackets 21 or means for controlling the opening of the nozzle along its entire length. About 45° below the horizontal and towards the nozzle, the header 8 has a large longitudinally extending port 22 on the edges of which are fastened an upper lip 23 and a lower lip 24 by means, in this embodiment, of screws 25. The upper lip 23 is rigid and stationary and the lower lip 24 is made flexible by the formation of a longitudinally extending groove 26 close to the region where it is fastened to the header.

Suitably spaced pins 27 pass through and are secured to the lip 24 and the heads of those pins are disposed in counterbored regions of the openings of the lip through which the pins pass. The lower ends of the pins 27 may be drawn downwardly by distances which may be different from pin to pin so that the thickness of the fluid blade issuing from the nozzle 6 may be adjusted as desired across its entire length.

With this arrangement it is possible, regardless of the width of the metallic strip to be treated, to arrange that the thickness of the fluid blade across the length of the metallic strip may have desired values.

It is also important that the configuration of the nozzle slot may be varied even during operation of the device and of course this was not possible in the prior art arrangements. As parricularly shown in FIG. 2, the lower ends of pins 27 are supported in a turnable and axially slidable way in bushes mounted in brackets 21. The pins are threaded over a portion of their length and are received within correspondingly threaded rotatable but axially fixed wheels 30, the outer surface of which wheels are provided with gear teeth engaging a second wheel, not visible in the drawing, disposed at 90° thereto and rotated by shaft 31 which may be remote controlled. It is, of course, to be appreciated that the adjustment of the individual pins may be achieved in any desired way.

Other characteristics and advantages of the particular arrangement of FIGS. 6 and 7 are to be found in the aforementioned U.S. Pat. No. 3,753,418.

What is claimed is:

1. An improved device for the continuous adjustment of the zinc coating on a metal strip coming from a molten zinc bath at controlled temperature, of the type comprising a pair of horizontal manifolds arranged for positioning just above the bath surface on both sides of the metal strip, said manifolds each comprising an elongated nozzle, each of said manifolds being supported by a pair of pivotally mounted feed conduits which communicate with the ends of said each manifold, means to simultaneously adjust the pair of nozzles with respect to angular relationships and the distance therebetween, each said nozzle comprising a pair of elongated lip members defining therebetween slot means for directing a stream of gases from said elongated nozzle to impinge on the sides of the metal strips, wherein the lower lip, near its base, is fastened to said manifold and is provided on its lower face with a slot parallel to said elongated nozzle, characterized in that said lower lip comprises deformable means for varying the longitudinal profile of said slot means, a plurality of pulling and pushing means for deforming said deformable means arranged at selected distances under said lower face and parallel slot and a plurality of remote control means singularly acting on said pulling and pushing means, connecting means between said remote control means and said pulling and pushing means, and two substantially rigid elongated side shutters arranged in end to end spaced relationship inside said nozzle, means mounting said shutters against the inner surfaces of said lips for simultaneous sliding and sealing contact therewith while said manifolds are operative or inoperative for thus minimizing coating deformations along the edges of the strip.

2. The device of claim 1 wherein said shutters are formed by linear, elongated bars having a cross section substantially equivalent to the inner cross sectional profile of said nozzle adjacent said slot and said shutters being slidable in a linear manner against the inner surfaces of the lips defining the slot-like nozzle.

3. The device of claim 2 wherein means are provided for sliding said shutters against said inner surfaces for controlling the linear nozzle which is defined between adjacent ends of said shutters.

* * * * *